United States Patent [19]

Yonkers et al.

[11] 4,293,234

[45] Oct. 6, 1981

[54] RIBBON CARTRIDGE FOR BAND PRINTER

[75] Inventors: Edward H. Yonkers, Newton; Gilbert A. LeDoux, East Taunton, both of Mass.

[73] Assignee: Data Packaging Corporation, Cambridge, Mass.

[21] Appl. No.: 67,770

[22] Filed: Aug. 20, 1979

Related U.S. Application Data

[63] Continuation of Ser. No. 897,861, Apr. 19, 1978, abandoned.

[51] Int. Cl.[3] ..... B41J 33/10

[52] U.S. Cl. ..... 400/196.1; 400/195; 400/235.1

[58] Field of Search ..... 400/194, 195, 196, 196.1, 400/207, 208, 208.1, 235.1

[56] References Cited

U.S. PATENT DOCUMENTS

| | | | |
|---|---|---|---|
| 3,840,107 | 10/1974 | Mack et al. | 400/208 X |
| 3,877,561 | 4/1975 | Guerrini et al. | 400/235.1 X |
| 3,904,017 | 9/1975 | Frechette | 400/235.1 X |
| 3,941,231 | 3/1976 | Matuck et al. | 400/235.1 X |
| 3,973,707 | 8/1976 | Pratt et al. | 400/196.1 X |
| 3,974,906 | 8/1976 | Lee et al. | 400/196.1 |
| 3,981,387 | 9/1976 | Gottschlich | 400/195 X |
| 3,989,132 | 11/1976 | Carson, Jr. | 400/196.1 X |
| 4,033,445 | 7/1977 | Oddicini | 400/235.1 X |
| 4,131,372 | 12/1978 | Hengelhaupt | 400/196.1 |
| 4,161,270 | 7/1979 | Casey | 400/195 X |

FOREIGN PATENT DOCUMENTS

| | | | |
|---|---|---|---|
| 2136777 | 12/1977 | Fed. Rep. of Germany | 400/196.1 |

OTHER PUBLICATIONS

IBM Technical Disclosure Bulletin, "Mobius Guide", Dowd, vol. 20, No. 6, Nov. 1977, P.2175.

*Primary Examiner*—Ernest T. Wright, Jr.
*Attorney, Agent, or Firm*—Wolf, Greenfield & Sacks

[57] ABSTRACT

A ribbon cartridge is detachably connectable to a high speed band printer. The cartridge includes a body which has a ribbon storage compartment where the ribbon is contained in a multiplicity of serpentine folds. The body has a ribbon inlet end and outlet end, and guide arms extend from the inlet and outlet ends to guide the endless ribbon to define an exposed loop of the ribbon between the outermost ends of the guide arms. The exposed loop is positioned in the printer adjacent the paper to enable the ribbon to be impacted by appropriate printing characters. The body includes an opening which receives the ribbon drive rollers of the printer in a manner which engages the ribbon and advances it progressively. Adjacent the inlet end of the body, and in the region of the opening, the device includes a ribbon control assembly which cooperates with the rollers to assure proper threading of the ribbon between the rollers as well as to minimize any tendency for the ribbon to jam in the machine or in the cartridge. The outlet end of the body contains a mobius loop device which reverses the ribbon as it begins to exit from the cartridge so as to present the opposite face of the ribbon to the paper during the next printing cycle. The ribbon control assembly is operated automatically and concurrently with movement of the drive rollers to grip or release the ribbon.

7 Claims, 9 Drawing Figures

120
14
24
26
3
68
32
72
60
71
74
78
73
64
76
62
66
84a
80
34
84b
90
20
R
18
22
10
8
58
16
7
124
148
126
144
48
40
44
42
50
128
2
129
122
12
138
150
28
30
56
52
46

22
20
70
66
152
150
140
138
142
124
12
R
120
122
129
130
136
128
134
132

RIBBON CARTRIDGE FOR BAND PRINTER

This is a continuation of application Ser. No. 897,861, filed Apr. 19, 1978, now abandoned.

BACKGROUND AND SUMMARY OF THE INVENTION

This invention relates to improvements in endless printing ribbon cartridges for use in high speed band printers. Recent years have seen the development of such high speed printers, for example of the type used in connection with computer systems or the like. It is among the desirable characteristics of such printers that there be a simple, trouble-free means by which a substantially continuous supply of printing ribbon can be loaded in and fed through the printer. To this end, a number of ribbon cartridges have become available commercially. They have not been free of difficulty and, in some instances, are believed to have seriously interfered with the substantially continuous and high speed operation of the printing device. For example, the printers typically have a pair of drive rollers which are an integral part of the printer mechanism and which are intended to receive and grip the endless ribbon to advance it progressively through the cartridge and then the printer. It is not uncommon for difficulties to be encountered when the cartridge is first inserted into the machine, where the ribbon may not automatically locate itself properly with respect to the drive rollers. As a consequence, the ribbon may not be gripped properly by the drive rollers which may cause the printer and/or cartridge to jam. In addition, it sometimes may occur that even if the ribbon is oriented properly with respect to the drive rollers, the ribbon may wrap about the drive roller in a manner which also causes jamming. In addition, while it is desirable that such cartridges be of inexpensive, low cost construction so that they may be disposable, the devices which have been proposed or used thus far generally are quite complicated which not only adds to the expense of their manufacture but also tends to increase the chance of failure during operation.

In brief, the present invention utilizes an elongate cartridge housing having an inlet end and an outlet end through which the printing ribbon enters and exits. A pair of arms extend from the inlet and outlet ends of the housing, to define a generally U-shaped configuration, and serve to guide the ribbon into and then out of the housing. The ribbon thus extends from the outer end of the arms to define an exposed loop which is utilized in the printer to print the desired characters on the paper. The ribbon advances from the exposed loop, through the arm at the inlet end of the housing and then through a ribbon control assembly to the drive rollers of the printer. The rollers protrude into the interior of the housing when the cartridge is in place on the printer.

The ribbon control assembly includes guide means which assures that the ribbon will always be positioned properly between the drive rollers when the cartridge is initially inserted into the printer as well as during operation of the printer. The control assembly also includes fingers which, when the assembly is shifted to its drive position, wrap about the drive rollers to further guide the ribbon and assure that the ribbon cannot inadvertently be caught by and wrapped about the drive rollers. This contributes materially to the jam-free characteristic of the invention. The control assembly is supported to slide back and forth within the inlet end of the housing in response to operation of the lever in the printer which locks and unlocks the drive rollers.

The outlet end of the body is provided with a mobius loop device which reverts the ribbon so that during each successive external loop, its surfaces will be reversed. The outlet end of the storage chamber is provided with a wall which serves as an outlet end dam and the wall is provided with a slot to guide the ribbon to the mobius loop device. In addition, a restriction is interposed within the storage chamber upstream of the dam to minimize any tendency for the ribbon to become jammed in the region of the dam.

It is among the general objects of the invention to provide an improved ribbon cartridge for a high speed band printer.

A further object of the invention is to provide a ribbon cartridge of the type described which displays a substantially reduced tendency to jam.

Another object of the invention is to provide a ribbon cartridge of the type described in which the cartridge can be inserted into the machine in a manner which assures proper registration of the ribbon with respect to the drive rollers.

A further object of the invention is to provide a ribbon cartridge in which the ribbon cannot fall out of the housing.

Another object of the invention is to provide a ribbon cartridge which is low cost and inexpensive construction and which embodies simple mechanisms, whereby it lends itself to disposable use.

DESCRIPTION OF THE DRAWING

The foregoing and other objects and advantages of the invention will be appreciated more fully from the following further description thereof, with reference to the accompanying drawing wherein.

DESCRIPTION OF THE PREFERRED EMBODIMENT

Figure 1:
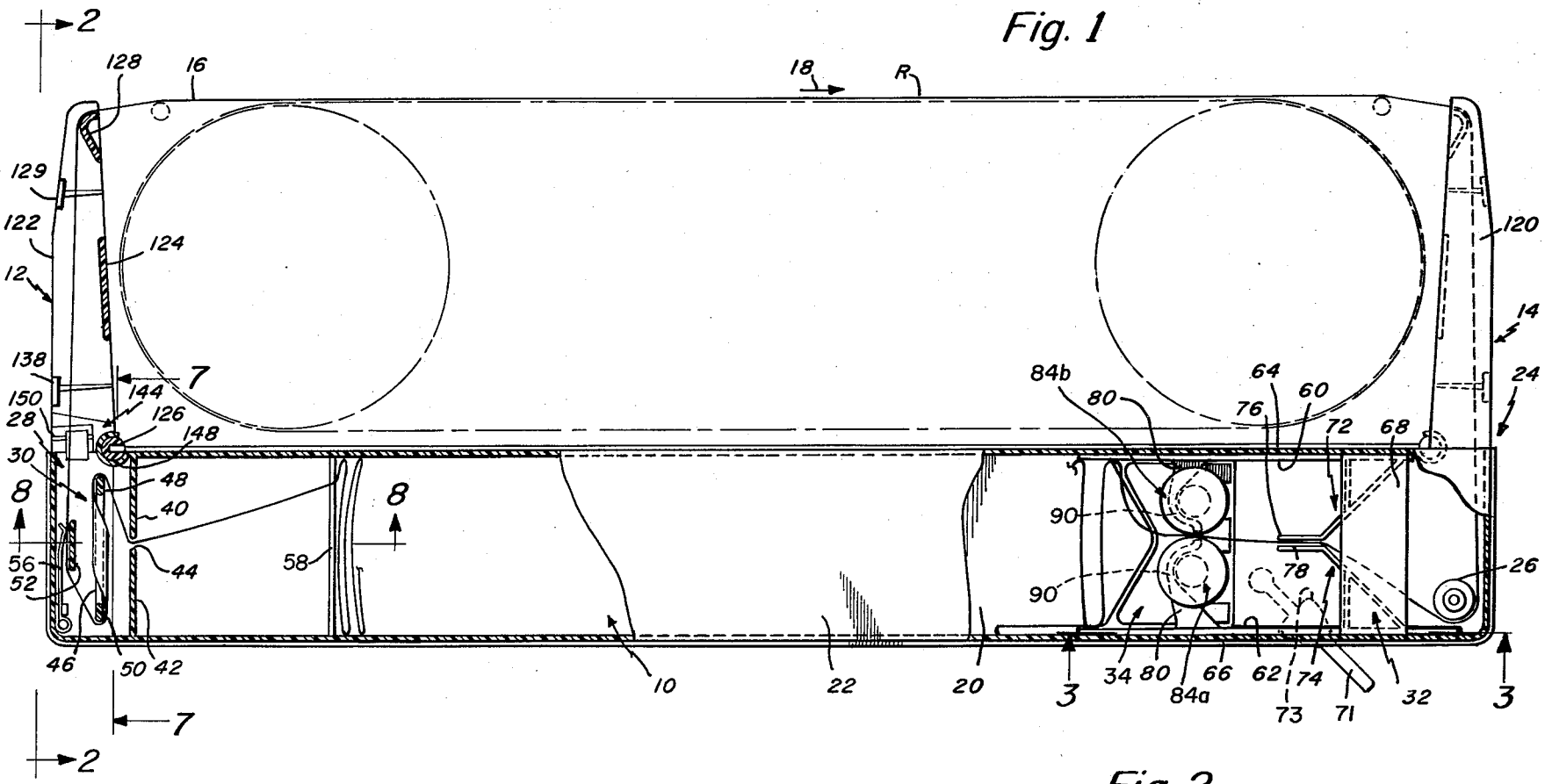
FIG. 1 is a plan illustration of the device, partly broken away.

As shown in FIG. 1, the ribbon cartridge includes a body 10 and a pair of arms 12 and 14 which, as shown in FIG. 1, define a generally U-shaped configuration. The parts of the device preferably are formed from plastic, molded to shape. The body 10 is constructed to contain approximately one hundred yards of printing ribbon (indicated in FIG. 1 as "R") which is folded upon itself in closely packed folds and in serpentine fashion. The stored portion of the ribbon R in the body 10 forms part of an endless ribbon R with an exposed loop 16 that extends between the ends of the arms 12 and 14. The ribbon R moves through the cartridge and across the ends of the arms 12, 14 in the direction suggested by the arrow 18. The ribbon R is transported by a pair of drive rollers 84*a*, 84*b* which are part of the printer and which extend into the body 10 when the cartridge is placed on the printer.

The body 10 may be formed in sections, including a base 20 and a cover 22 which are separately molded and welded or otherwise secured together after the cartridge is loaded with the ribbon R. The various parts of the cartridge, including the ribbon R, are assembled in the cover 22 and thereafter the cover 22 and base 20 are secured together.

It may be noted that the cover 22 is formed to include a top wall 70 and a skirt or sidewall 66 which extends downwardly away from the top wall 70. During loading of the device with its various elements, the cover 22 is inverted so that the skirt 66 extends upwardly, to provide access to the interior of the cover 22.

The inlet end 24 of the body 10 is provided with an idler roller 26 which is mounted on the cover 22 and is designed to slip over an axle (not shown) which protrudes from the printer to sense the motion of the ribbon R. The idler roller 26 also serves as a guide for the ribbon R which enters the body 10 through the arm 14. At the exit end 28 of the body a mobius loop support 30 is molded as an integral part of the cover 22 so as to turn the ribbon R over within the body 10 on each revolution of the ribbon R through the system.

Intermediate the inlet and outlet ends 24, 28 (but adjacent the inlet end 24) of the body 10, a ribbon control assembly 32 is movably supported in the cover 22 for preventing the closely packed ribbon R from falling out through an opening 34 in the base 20 through which the drive rollers 84*a*, 84*b* extend, as well as for assuring that the ribbon R peels smoothly from the drive rollers 84*a*, 84*b* so as to prevent jamming. In addition, the ribbon control assembly 32 supports the ribbon R in position so that when the cartridge is installed on the printer the ribbon R automatically falls between the drive rollers 84*a*, 84*b* so as to be in proper registry for engagement by them when placed in operation.

Figure 6:
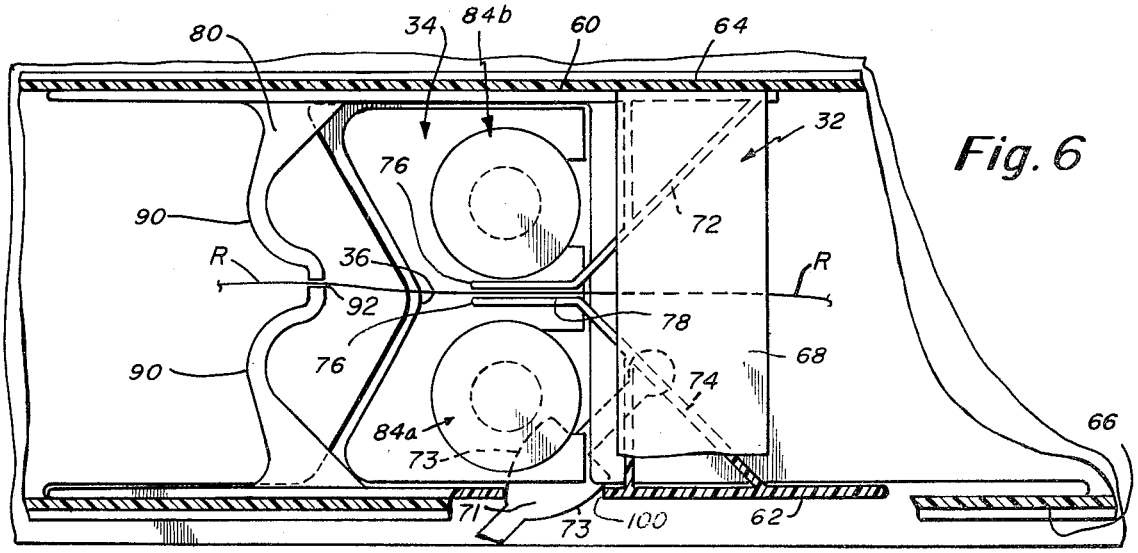
FIG. 6 is an enlarged illustration of the retainer and peeler shuttle, viewed in plan, with the shuttle in place in the printer but before the rollers have been closed to grip the ribbon.

As shown in FIGS. 1 and 6 base 20 is formed to define the opening 34 in its horizontal bottom wall to enable the drive rollers 84*a*, 84*b* to protrude into the body 10 when the cartridge is connected to the printer. The opening 34 is generally U-shaped so that the bottom wall of the base 20 extends toward the rollers 84*a*, 84*b* and is in close proximity thereto, as indicated at 36. In the embodiment shown, this portion of the base 20 tapers toward the outlet of the rollers 84*a*, 84*b*. Consequently, support is provided for the ribbon R almost immediately after it exits from between the rollers 84*a*, 84*b*, and there is no transverse partition of substantial extent to impede the flow of the ribbon R.

Figure 7:
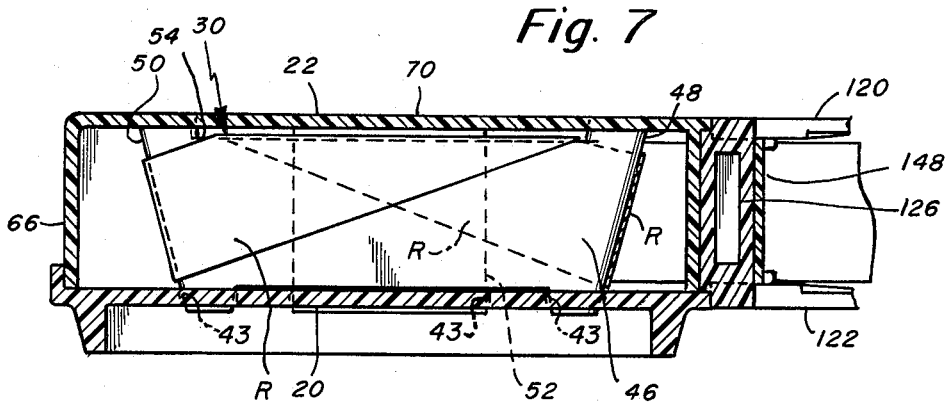
FIG. 7 is an illustration of the mobius loop portion of the cartridge as seen along the line 7—7 of FIG. 1.

As will be described in further detail herein, the ribbon R exits from the rollers 84*a*, 84*b* to the intermediate storage region of the body 10 where the ribbon R is retained in a multiplicity of serpentine loops. The outlet end of the intermediate storage chamber is defined by a pair of aligned walls 40 and 42, formed integrally with the cover 22. The lower edges of the walls 40, 42 may protrude into slots in the base 20 to stabilize the walls 40, 42. The adjacent ends of the walls 40, 42 are spaced from each other to define an exit slot 44 through which the ribbon R exits from the storage chamber and then passes to the mobius loop support 30. As mentioned, the mobius loop support 30 is molded integrally with the cover 22. It includes a partition 46 which extends parallel to the walls 40, 42. The partition 46 includes an upper edge 54 which is rounded smoothly and which is spaced below the inner surface of the cover 22. The partition 46 is formed to include downwardly converging end edges 48, 50 (FIG. 7) about which the ribbon R is wrapped, and which actually serve to turn the ribbon R, as suggested in FIGS. 1 and 7. A third wall 52 is disposed parallel to and spaced from the partition 46 to orient the ribbon R as it leaves the mobius loop support 30 so that the ribbon R may exit from the body 10 through the arm 12 and in a reversed attitude. A leaf spring 56 preferably is attached to the cover 22 and bears against the guide wall 52 to press the ribbon R lightly against the surface of the guide wall 52. Because of the orientation of the walls 40, 42, 52 and partition 46, the ribbon R does not rub against itself in the mobius loop so that wear of the ribbon R is minimized. The lower ends of the mobius loop support 30 and guide wall 52 may have projections which are received in slots 43 of the base 20 for rigidity.

Figure 8:
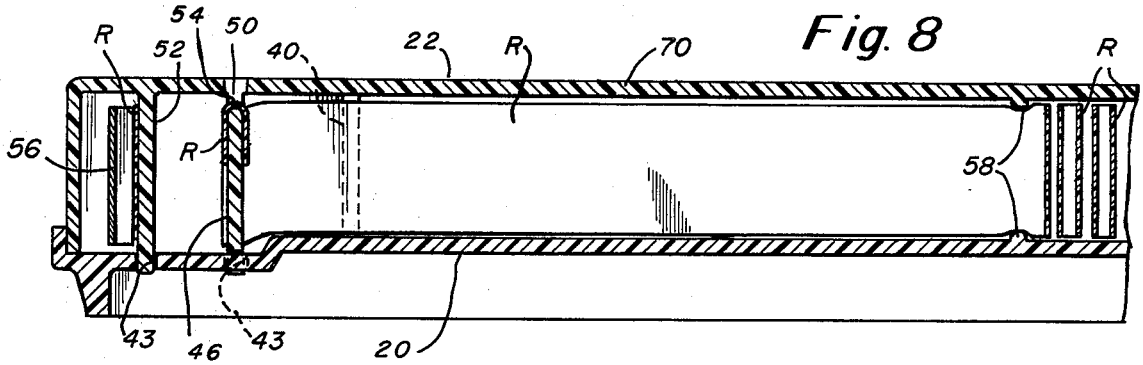
FIG. 8 is an illustration of the outlet end of the cartridge as seen along the line 8—8 of FIG. 1.
Figure 9:
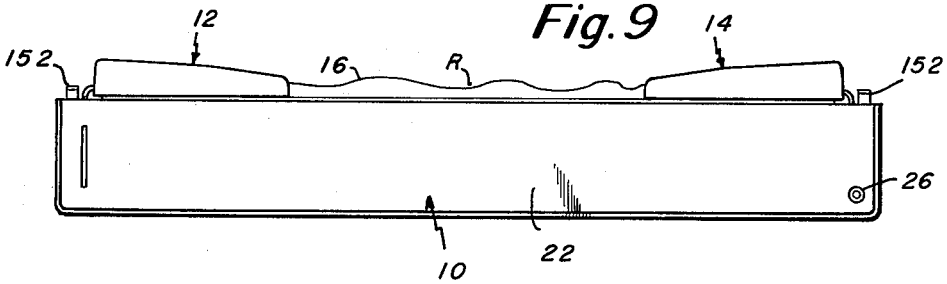
FIG. 9 is a reduced scale plan view of the cartridge with its arms folded to a storage configuration.

In the preferred embodiment, the stored serpentine ribbon R is not permitted to maintain its serpentine configuration all the way up to the walls 40, 42 in order to avoid a tendency for the ribbon R to become jammed at the walls 40, 42. Thus, as shown in FIGS. 1 and 8, the base 20 and/or the cover 22 is provided with a ridge 58. The ridge or ridges 58 are arranged so that they restrict the passage within the storage chamber so that the ribbon R cannot pass beyond the ridges 58 while in a serpentine configuration. However, because of the flexible character of the ribbon R, it can flex to pass through the constriction defined by the ridges 58 and thus advance to and through the slot 44. The drag imparted to the ribbon R causes it to pass from the ridges 58 to the slot 44 in a straight line.

As mentioned, the cartridge includes means to assure proper positioning of the ribbon R between the drive rollers 84*a*, 84*b* when the cartridge is attached to the printer as well as means for retarding a tendency for the ribbon R to wrap about the rollers 84*a*, 84*b* or otherwise jam in the system. To this end, the cartridge includes the ribbon control assembly, indicated generally at 32 and illustrated in FIGS. 1 and 3–6. The ribbon control assembly 32 is mounted in the cartridge for movement toward and away from the drive rollers 84*a*, 84*b*, and is illustrated in its most forward position in FIG. 6 (when first inserted into the printer) and in its retracted position in FIG. 1 (when the device is in operation). In this regard, it should be noted that when the printer is idle and is ready to receive a fresh ribbon cartridge, the drive rollers 84*a*, 84*b* will be in the separated position illustrated in FIG. 6, so that the ribbon R may be located between the rollers 84*a*, 84*b*.

After the cartridge has been positioned, the rollers 84*a*, 84*b* then are brought together, as illustrated in FIG. 1, to grip the ribbon R so that they may advance the ribbon R. In a typical commercially available printer, the drive rollers 84*a*, 84*b* are brought together or separated by an actuating lever 71 which is mounted in the printer for lateral pivotal movement and which is operatively connected to the drive rollers 84*a*, 84*b* to open or close them. The particular mechanism by which lever 71 opens or closes the rollers 84*a*, 84*b* is not critical to the present invention and is not described herein, except to the extent that movement of the lever 71 between its positions cooperates with the cartridge as is described. Additionally, it may be noted that in the present disclosure, the printer is of the type in which one of the rollers 84b is maintained in a stationary location in the printer and the other of the rollers 84a is movable toward and away from the stationary roller 84b.

The ribbon control assembly 32 includes a pair of connected parallel sidewalls 60 and 62 designed to extend along the front and rear skirt portions 64 and 66 respectively of the cover 22. The walls 60 and 62 are connected by a panel 68 which lies just beneath the top wall 70 of the cover 22. A pair of guides 72 and 74 carried by the panel 68 converge in the direction of motion of the ribbon R, and each guide 72, 74 terminates in a short section 76 which define a narrow guide slot 78 for the ribbon R. The sections 75 and guides 72, 74 form a generally Y-configuration.

Each of the walls 60 and 62 carries a number of vertically spaced fingers 80 disposed in horizontal planes which are designed to lie in the appropriate grooves 82 formed in the drive rollers 84a, 84b when the assembly 32 is in the operative position (FIG. 1). Each of the fingers 80 includes an arcuate portion 90 which wraps partially about and in close proximity to the reduced diameter hubs of the rollers 84a, 84b, as suggested in FIG. 1. The outer ends of each of the fingers 80 is reverted and the adjacent ends of the fingers 80 on opposite sides are slightly spaced from each other to define slot 92 which helps to guide the ribbon R through the nip line of the drive rollers 84a, 84b when the device is in operation. As may be seen from FIG. 1, the fingers 80 are disposed so that the guide slot 92 is slightly in advance of the nip line of the drive rollers 84a, 84b when the device is in its operating position. When the cartridge is removed from the printer or is otherwise in its inoperative configuration (FIG. 6) the ribbon control assembly 32 is in its more forward position and the fingers 80 are advanced to a position which forms a dam in the body 10 to prevent the closely packed serpentine folds of the ribbon R to back out of the body 10 and all through the opening 34 in the base 20 of the cartridge.

The assembly 32 is shifted between its positions simultaneously with the opening and closing of the rollers 84a, 84b by means of cooperation of the assembly 32 with the actuating lever 71 for the rollers 84a, 84b. As shown in the drawing, a cam slot 100 is formed in the lower edge of wall 62 through which the actuating lever 71 extends when the cartridge is mounted on the printer. The actuating lever 71 is connected to one of the drive rollers 84a and when moved to the right as viewed in FIG. 6, places the drive roller 84a against the fixed drive roller 84b so that the rollers 84a, 84b are in position to pinch the ribbon R and advance it in the cartridge. The actuating lever 71 includes a pair of cam surfaces 73 which are designed to engage the edges of the slot 100 so as to move the assembly 32 smoothly between its extreme positions.

In FIG. 6, the assembly 32 is shown in the position it occupies when the cartridge is initially mounted on the printer. It will be noted that in that position, the guides 72 and 74 and more particularly, their extensions 76 are disposed between the drive rollers 84a, 84b so as to orient the ribbon R in the proper location between those rollers 84a, 84b as the cartridge is placed on the printer. In the same position, the fingers 80 are spaced forwardly from the rollers 84a, 84b and lie beyond the forward end 36 of the opening 34 in base 20 through which the drive rollers 84a, 84b extend so that the fingers 80, and more particularly, their arcuate leading edges 90, define the dam which prevents the ribbon R in the body 10 from backing up and falling through the opening 34.

After the cartridge is placed in position on the printer, the lever 71 is moved to the right as shown in FIG. 1 and the assembly 32 shifts to the right so that the sections 76 of the guides 72, 74 are pulled beyond the drive rollers 84a, 84b. Simultaneously, the arcuate portions 90 of the fingers 80 are drawn into the appropriate grooves 82 formed in the drive rollers 84a, 84b to assure that the ribbon R will not wind about the rollers 84a, 84b and jam the cartridge.

Figure 2:
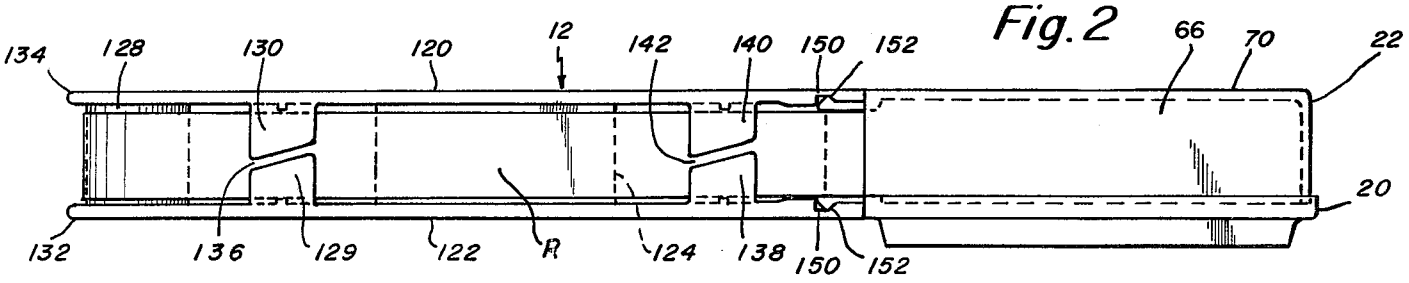
FIG. 2 is an end view of the cartridge as seen along the line 2—2 of FIG. 1.
Figure 3:
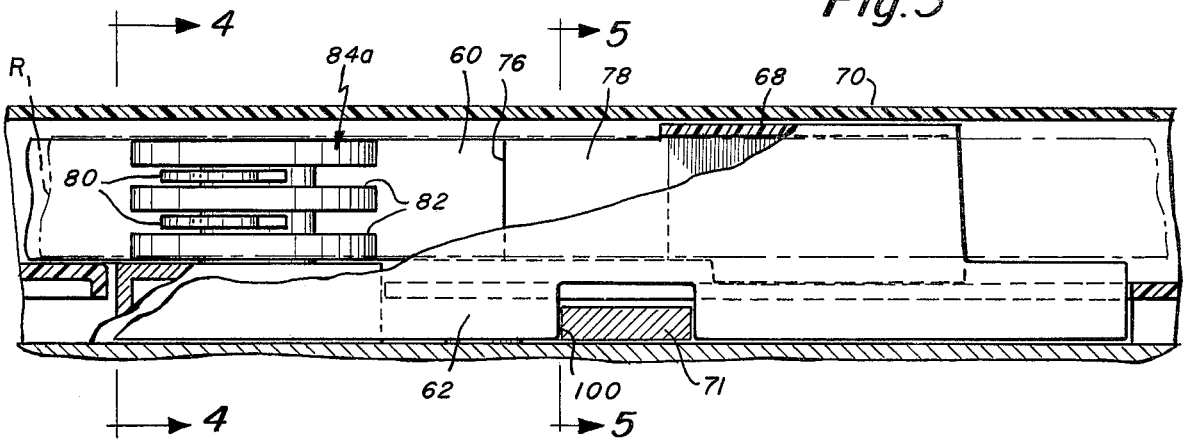
FIG. 3 is a partly broken away and sectional illustration of the inlet region of the cartridge as seen along the line 3—3 of FIG. 1.
Figure 4:
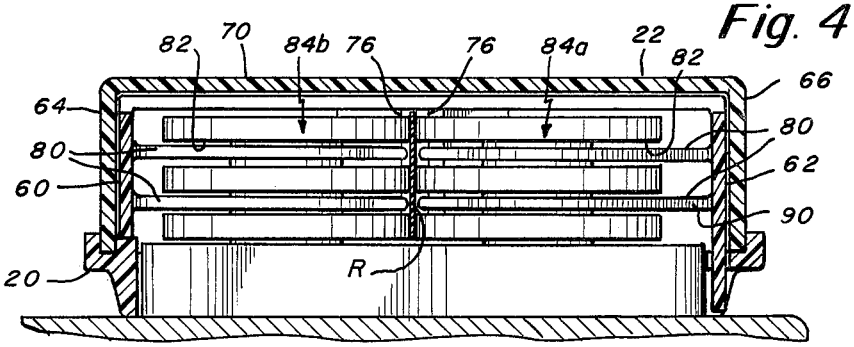
FIG. 4 is an illustration of the cartridge and drive rollers as seen along the line 4—4 of FIG. 3.
Figure 5:
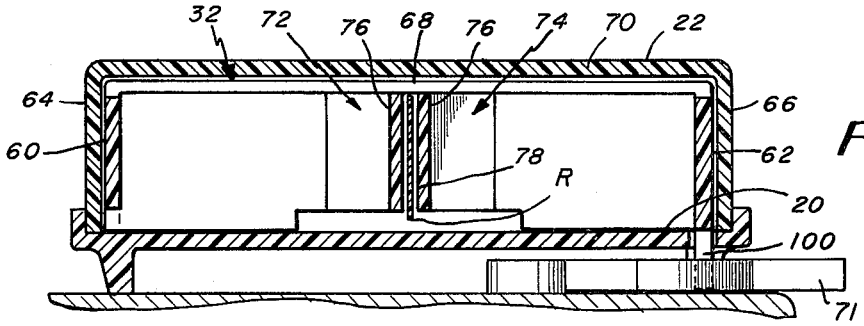
FIG. 5 is an illustration of the ribbon guide as seen along the line 5—5 of FIG. 3.

The arms 12, 14 are identical. They are separately molded and thereafter pivotally mounted to the body 10. Because the arms 12, 14 are identical and are merely only inverted with respect to one another, only one will be described. Arm 12 as shown in FIGS. 1 and 2 includes an upper wall 120 and a lower wall 122 which are connected together by a short vertical wall 124, a pivot post 126 and a guide 128. The wall 124, post 126 and guide 128 all are arranged along the inner side of the arm 12, that is, the side facing the other arm 14 of the cartridge.

A pair of flanges 129 and 130 extend toward one another from the outer edges 132 and 134 respectively of the upper and lower walls 120 and 122 and are separated by an inclined slot 136. A similar set of flanges 138 and 140 are formed on the upper and lower walls 120, 122 adjacent the post 126, and they also are separated by an inclined slot 142. The inclined slots 136, 142 facilitate threading of the ribbon R through the arms 12, 14 but at the same time their inclination prevents the ribbon R from accidentally sliding out the slots 136, 142.

The post 126 formed at the corner 144 of the arm 12 is designed to snap into a channel 148 formed in the front wall of the cover 22 so as to pivotally support the arm 12 on the body 10. A pair of ribs 150 are formed on the inner surfaces of the walls 120 and 122 at the end of the arm 12 near the post 126, and the ribs 150 are positioned to be engaged by a snap 152 carried by the body 10 so as to retain the arms 12, 14 in their extended position. The snap arrangement is shown in detail in FIG. 2. The snap retainer may be overcome merely by sufficient force applied to the arm 12 so as to pivot it in the direction of the front wall of the body 10 so that it lies in the collapsed position.

In operation, the arms 12 and 14 are extended and the cartridge is placed on the deck of the printer. The assembly 32 is in the left-most position as shown in FIG. 6 and as the cartridge is dropped into place, the sections 76 of the guides 72, 74 support the ribbon R and places it between the drive rollers 84a, 84b. At the same time, the fingers 80 prevent the ribbon R in the body 10 from falling out of the opening 34. With the cartridge in place, the actuating lever 71 is pivoted to the right as viewed in FIG. 1, which moves the assembly 32 to the right and withdraws the sections 76 of the guides 72, 74 from between the rollers 84a, 84b. At the same time, the fingers 80 assume their operative positions within the grooves 82 formed in the drive rollers 84a, 84b so as to peel the ribbon R from the drive rollers 84a, 84b. When the drive rollers 84a, 84b are rotated, the ribbon R is drawn by the rollers 84a, 84b as described. The mobius loop device 30 at the exit end 28 of the body 10 causes the ribbon R to turn as it passes that location so as to constantly invert the ribbon R. So as to feed the ribbon R demanded by the rollers 84*a*, 84*b*, the ribbon R is exited from the cartridge arm 12 and is drawn across the gap between the ends of the arms 12, 14 where it is engaged by the printer.

Having thus described the invention, what we desire to claim and secure by Letters Patent is:

1. A ribbon cartridge for a high speed printer comprising:

an elongated body and a pair of arms extending from opposite ends of the body and to one side thereof to form a generally U-shaped ribbon container and an endless ribbon packaged in the container with an exposed loop extending between the ends of the arms;

a ribbon passage in each arm extending from the body to the ends of the arms and a chamber in the body for storing a substantial portion of the endless ribbon and in communication with the passages in the arms;

an opening in the bottom of the body for receiving a pair of drive rollers within the body when the cartridge is mounted on the printer;

a ribbon control assembly mounted in the body for movement between a first position which disposes the ribbon between the rollers when the cartridge is mounted on the printer, and a second position in which the ribbon portion between the rollers is exposed to the rollers thereby to enable the rollers to grip and drive the ribbon; and said ribbon control assembly further including means defining a ribbon dam disposed beyond the location of the rollers for preventing the ribbon from falling out of the body through said opening.

2. A ribbon cartridge for high speed printers as defined in claim 1 further characterized by said dam including a plurality of fingers extending from the sides of the ribbon control assembly to the periphery of the rollers when the assembly is in the second position for peeling the ribbon from the rollers.

3. A ribbon cartridge for high speed printers as defined in claim 1 further characterized by a mobius loop guide mounted in the container for forming a mobius loop in the ribbon.

4. A ribbon cartridge for high speed printers as defined in claim 1 further characterized by said assembly including a pair of guide flanges which converge toward one another in the direction of the movement of the ribbon, the closer ends of the flanges lying between the rollers when the cartridge is on the printer and the assembly is in the first position.

5. A ribbon cartridge for high speed printers as defined in claim 1 further characterized by a mobius loop guide in the body adjacent the exit end thereof.

6. A ribbon cartridge for high speed printers as defined in claim 5 further characterized by said mobius loop guide including a first pair of walls closing the exit end of the chamber, said walls being spaced apart to define an exit slot for the ribbon from the chamber, and a panel generally parallel to the walls and having downwardly converging ends, said ribbon exiting through the slot extending around one end of the panel and then extending over the panel down the other side thereof to and around the second end of said panel to form a mobius loop.

7. A ribbon cartridge comprising:

a generally U-shaped container having a body and a pair of arms extending from opposite ends of the body, said body having a storage chamber for receiving closely packed sinusoidally wound ribbon, a wall at one end defining the exit side of the chamber, and a movable ribbon leading and peeling assembly defining the inlet end of the chamber, said assembly including guide flanges for positioning ribbon in the cartridge with respect to drive rollers when the cartridge is mounted on a printer, ribbon passages extending through the arms and communicating with the inlet and outlet ends of the chamber, and a mobius loop guide mounted in the body beyond the exit end of the chamber.

* * * * *